United States Patent [19]

Bar-Noy

[11] Patent Number: 4,768,403

[45] Date of Patent: Sep. 6, 1988

[54] COMBINATION OF BOTTLE OPENER AND BOTTLE HANDLE

[75] Inventor: Gideon Bar-Noy, Tel Aviv, Israel

[73] Assignee: M. M. Mutzar Matara Ltd., Tel Aviv, Israel

[21] Appl. No.: 108,536

[22] Filed: Oct. 15, 1987

[30] Foreign Application Priority Data

Nov. 6, 1986 [IL] Israel ..... 80521

[51] Int. Cl.[4] ..... B67B 7/44

[52] U.S. Cl. ..... 81/3.15; 81/3.44; 215/100 A

[58] Field of Search ..... 81/3.07, 3.09, 3.15, 81/3.4, 3.44; 215/100 A

[56] References Cited

U.S. PATENT DOCUMENTS

| | | | |
|---|---|---|---|
| 1,720,517 | 7/1929 | Joire | 81/3.15 |
| 1,859,614 | 5/1932 | Boever | 215/100 A |
| 1,976,623 | 10/1934 | Monroe et al. | 81/3.44 |
| 1,994,415 | 3/1935 | Edwards et al. | 81/3.15 |

FOREIGN PATENT DOCUMENTS

| | | | |
|---|---|---|---|
| 10192 | 6/1889 | United Kingdom | 81/3.44 |

OTHER PUBLICATIONS

International Application No. PCT/US82/01732, Pub. No. WO 83/02101, Pub. date 6/1983.

*Primary Examiner*—Roscoe V. Parker

*Attorney, Agent, or Firm*—Fleit, Jacobson, Cohn & Price

[57] ABSTRACT

A combination of a bottle screw-threaded twist-off cap opener and a handle which facilitates the holding of the bottle when it is held for pouring its contents.

3 Claims, 2 Drawing Sheets

COMBINATION OF BOTTLE OPENER AND BOTTLE HANDLE

FIELD AND BACKGROUND OF INVENTION

The present invention relates to a combination of a bottle opener and a handle for holding the bottle once it has been opened. More particularly, the invention relates to a device which is designed to facilitate the opening of bottles which until opened by a consumer are sealed with internal screw-threaded twist-off caps. The same device, thereafter, can serve as a handle for said bottle when it is held for pouring its contents.

It is well known that the release of twist-off caps is usually very difficult due to the fact that the cap is tightened so as to avoid the escape of liquids or gas therefrom and frequently also due to the provision of a safety ring which must be broken off by twisting the cap.

In order to ease the opening of twist-off caps, devices such as clamps, pliers, tweezers and the like were developed. All these arrangements were intended for the sole purpose of twisting of the cap.

OBJECT OF INVENTION

It is the object of the present invention to provide a device which is a combination of a twist-off opener and a handle which is attached to the bottle's neck so as to enable convenient pouring therefrom.

SHORT SUMMARY OF DISCLOSURE

The device consists of two parts pivotably connected with one another at one end thereof, each of said parts being provided with a semi-circular cut-out, the size of which corresponds approximately to the conventional twist-off cap, the open sides of the cut-outs facing complementarily each other, said parts comprising each two portions being bent to extend in different planes one relative to the other, and at least one of the parts defining an obtuse angle between the two portions, said two parts preferably being provided with additional means to immobilize one part relative to the other.

SHORT DESCRIPTION OF APPENDED DRAWINGS

The invention will now be described with reference to the annexed drawings, in which:

FIG. 1 is a side view of the device, while

Figure 1:
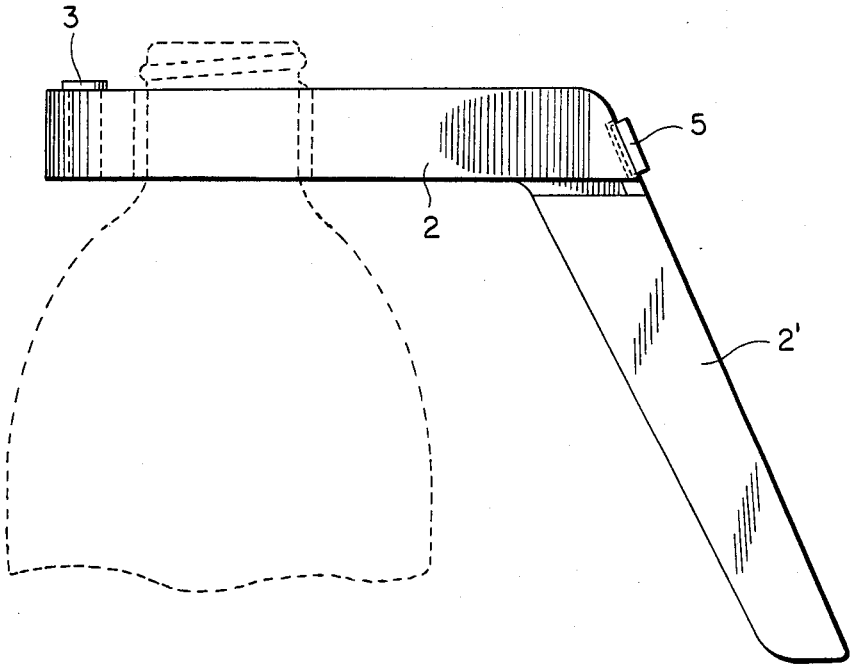
Figure 2:
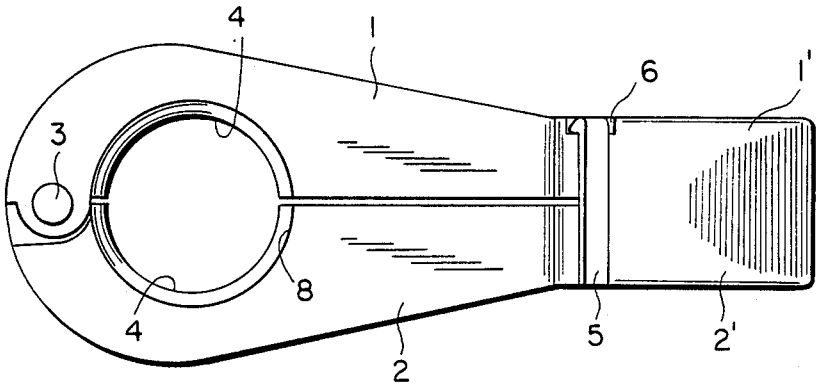
FIG. 2 is a top view thereof.
Figure 3:
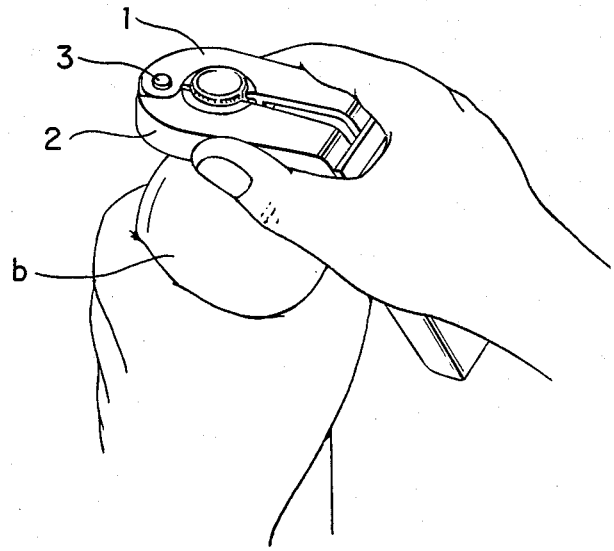
FIG. 3 illustrates the use of the device for opening a bottle.
Figure 4:
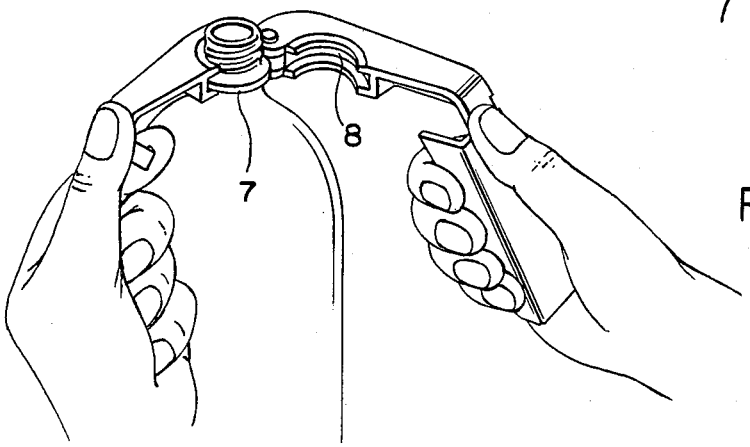
FIGS. 4 and 5 illustrate the use of the device as a handle for a bottle.

Turning first to FIGS. 1 and 2, the device consists of two parts, 1 and 2 being pivotably connected by means of a pin 3. Each of said two parts 1 and 2, is provided with a semi-circular cut-out 4, the rims of said cut-outs are roughened or toothed to ensure a firm grip on a screw cap and to prevent sliding when used to twist off a screw cap.

Part 2 is further provided with a hook-like member 5, while part 1 is provided with a notch 6, which enables the fastening of both parts together when used as a handle.

Some bottles, nowadays are moulded of plastic and for technical reasons of manufacture are provided with a circumferential ridge 7, at their neck which, incidentally, provides a better hold of the handle. The inner surfaces of cut-outs 4 are provided each with a semi-circular groove 8, into which the circumferential ridge 7 enters when both parts 1 and 2 are attached to the bottle.

Figure 5:
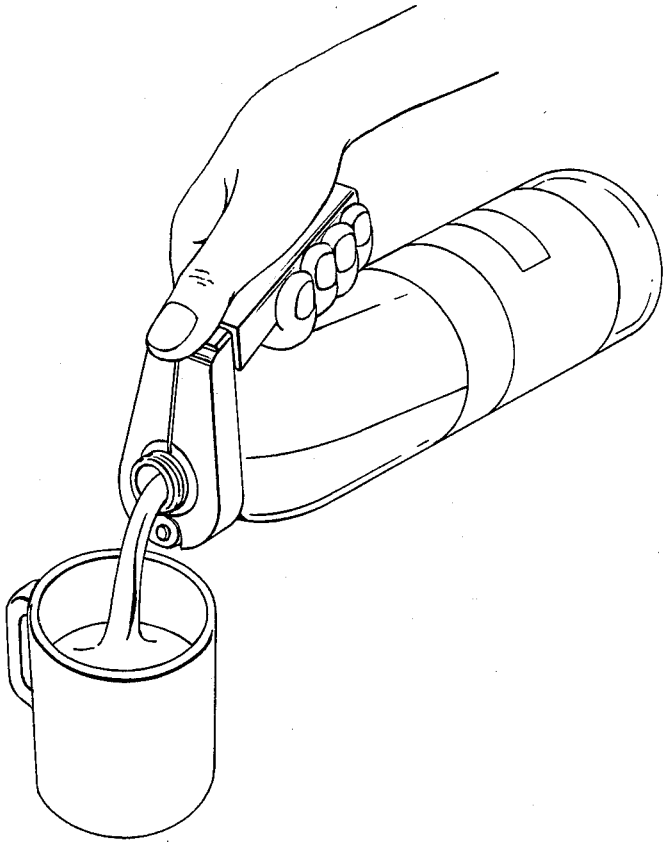

As can be seen in annexed drawings, parts 1 and 2 of the new device are extended to have tail-pieces 1' and 2', which latter, with the main portions of these parts define and obtuse angle. When the device is placed onto a bottle and firmly grips the neck thereof, (see FIG. 5), the device functions as a handle of the bottle and permits convenient pouring of its contents.

I claim:

1. A combined bottle opener and handle which consists of two parts pivotably connected with one another at one end thereof, each of said parts being provided at their other ends with a semi-circular cut-out, the size of which corresponds approximately with the conventional twist-off cap, the open sides of the cut-outs facing complementarily with each other, said parts comprising two portions being bent to extend in different planes one relative to the other and at least one of the parts defining an obtuse angle between the two portions.

2. A combined bottle opener and handle, as claimed in claim 1, wherein the said two parts are provided with additional means to immobilize said two parts relative to one another.

3. A combined bottle opener and handle, as claimed in claim 1, wherein the inner surfaces of the cut-outs are provided with a semi-circular groove to receive a circumferential ridge at the neck of the bottle.

* * * * *